United States Patent [19]

Diaz

[11] 4,288,028

[45] Sep. 8, 1981

[54] REMAILABLE ENVELOPE

[76] Inventor: Jose O. Diaz, 8711 Carpenter Rd., Milan, Mich. 48160

[21] Appl. No.: 109,545

[22] Filed: Jan. 7, 1980

[51] Int. Cl.[3] ..... B65D 27/06

[52] U.S. Cl. ..... 229/73; 229/71; 229/81

[58] Field of Search ..... 229/71, 73, 92.7, 92.3, 229/85, 92.8, 80, 92.1, 81; 206/632

[56] References Cited

U.S. PATENT DOCUMENTS

| | | | |
|---|---|---|---|
| 3,380,648 | 4/1968 | De Lyra | 229/73 X |
| 3,908,892 | 9/1975 | Pelzer | 229/73 |
| 3,982,689 | 9/1976 | Retrum | 229/71 |
| 3,995,808 | 12/1976 | Kehoe | 229/73 |
| 4,089,418 | 5/1978 | Yale | 229/71 |

*Primary Examiner*—George T. Hall

*Attorney, Agent, or Firm*—Olsen and Stephenson

[57] ABSTRACT

A remailable envelope having an envelope body formed of front and rear panels, a first closure flap on the front panel and a return closure flap on the rear panel which is folded upon itself and inserted into the envelope body during the first mailing of the envelope. A perforated line divides the front panel into upper and lower panel portions, address information for the first mailing being exhibited by the lower panel portion. The upper panel portion is detachable at the perforated line by the addressee to expose the second closure flap for its expeditious removal from the envelope pocket. The second closure flap is large enough to substantially cover the lower panel portion during remailing and exhibits the address of the second addressee. The detachable upper panel portion can have advertising imprinted thereon or form a response document such as an order form for use by the addressee in return mailing to the sender.

9 Claims, 8 Drawing Figures

REMAILABLE ENVELOPE

BACKGROUND OF THE INVENTION

The present invention relates to remailable or reusable envelopes. Remailable envelopes are particularly advantageous for businesses in billing their customers because remailable envelopes promote prompt remittance by the customer to the business.

Remailable envelopes developed in the past have a variety of designs and characteristics. For example, U.S. Pat. No. 2,931,559, issued to Hilliard shows a reusable envelope having only a return closure flap inserted into the envelope pocket during its first mailing. The envelope is sent during the first mailing to the customer who then seals the envelope with the return closure flap. Although many of the prior art remailable envelopes are serviceable, they do not completely fulfill the basic objective of providing a remailable envelope that is easily prepared for remailing by the first adressee nor are they satisfactory for use in mailing addressed billing statements.

Many businesses imprint the addresses of their customers on billing statements or computer cards and place them in envelopes having windows through which the addresses are displayed. Utilizing the window-type envelope eliminates the need for retyping address information on each envelope. However, for return mailing purposes, the window normally is not needed. There is a need, therefore, for a remailable envelope having an address window used during the first mailing of the envelope and concealed when the envelope is remailed.

It is the general object of the present invention, therefore, to provide a remailable envelope that easily is prepared for remailing by the first addressee.

It is another object of the present invention to provide a remailable envelope having a window through which address information is displayed for the first mailing of the envelope and which is covered during remailing of the envelope so as to ensure complete privacy.

It is another object of the present invention to provide a remailable envelope having a portion which is detachable by the first addressee and which contains imprinted indicia appropriate for the particular circumstances.

It is another object of the present invention to provide a dual closure flap remailable envelope having a return mailing closure flap adapted for easy handling by the first addressee.

SUMMARY OF THE INVENTION

The present invention provides a remailable envelope consisting of front and rear panels forming an envelope pocket, wherein the front panel has a perforated line separating it into an upper panel portion and a lower panel portion. The lower panel portion is secured along its side and bottom edges to the rear panel. A first closure flap is connected to the front panel along the upper edge of the upper panel portion and closes the mouth of the envelope pocket during the initial mailing of the envelope.

A second closure flap is connected to the rear panel along its upper edge and during the first mailing of the envelope, the second closure flap is folded in half upon itself and inserted into the envelope pocket. The first addressee opens the envelope folding the upper panel portion away from the rear panel at the perforated line and, if desired, detaches the upper panel portion from the envelope. The perforated line is located on the front panel so that when the upper panel portion is folded back or detached, the lowermost edge of the folded second closure flap is located above the upper edge of the lower panel portion where it easily can be grasped and removed from the envelope in preparing it for remailing.

The remailable envelope may be provided with a window in its lower panel portion to enable the sender to insert in the envelope an item on which the address information of the addressee is imprinted for display through the window. The second closure flap is larger than the first closure flap and is dimensioned so that when it is removed from the envelope pocket, unfolded, and positioned to overlie the front panel, it will cover enough of the lower panel portion to conceal the window so as to ensure privacy during remailing of the envelope. Address information of the second addressee or the sender is imprinted on the second closure flap.

Further objects, features and advantages of the present invention will become apparent from a consideration of the following description when taken in connection with the appended claims and the accompanying drawing in which:

Figure 1:
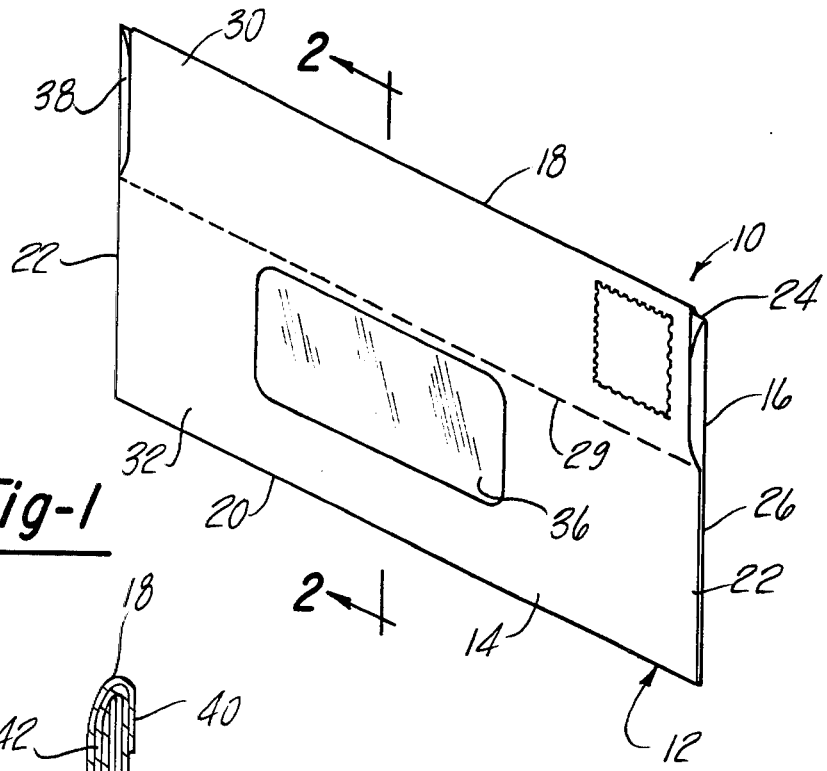
FIG. 1 is a perspective view of the remailable envelope of the present invention shown sealed for an initial mailing.

Referring to the drawing, the remailable envelope of this invention, indicated generally at 10, is shown in FIG. 1 consisting of an envelope body 12 having a front panel 14 and a rear panel 16 forming an envelope pocket 17 (FIG. 4) into which items such as billing statements, billing computer cards and remittances are inserted.

The front panel 14 has a top edge 18, a bottom edge 20 and side edges 22. The rear panel 16 has a top edge 24, side edges 26 and a bottom edge common with the bottom edge 20 of the front panel 14.

The front panel 14 has a fold or perforated line 29 extending lengthwise of the front panel 14 intermediate its upper edge 18 and the lower edge 20. The perforated line 29 defines an upper panel portion 30 and a lower panel portion 32. The upper panel portion 30 has a length slightly less than the lengths of the rear panel 16 and the lower panel 32 to facilitate the opening of the envelope 10 after its initial mailing. The lower portion 32 is provided with an address window 36 through which address information on a billing statement or a computer card (not shown) is displayed. Side flaps 38 connect the lower panel portion 32 to the rear panel 16 and extend upwardly to the top edge 24 of the rear panel 16. The side flaps 38 are positioned in a face-to-face relationship with the rear panel 16 being connected thereto at its side edges 26. The lower panel portion 32 is secured to the side flaps 38 by a suitable adhesive so that the front and rear panels 14 and 16 form the envelope pocket 17.

Figure 2:
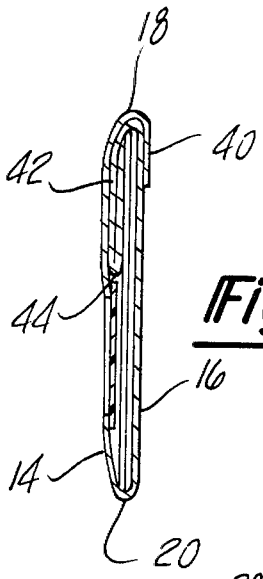
FIG. 2 is a transverse sectional view of the remailable envelope of the present invention taken substantially from line 2—2 in FIG. 1.

A first closure flap 40 (FIG. 2) is connected to the upper panel portion 30 at the top edge 18. Adhesive is provided on the closure flap 40 so that it can be secured to the outside surface of the rear panel 16 during the initial mailing of the envelope 10. A second or return closure flap 42 is connected to the rear panel 16 at its upper edge 24 and is folded upon itself (FIGS. 2 and 4) at the fold line 44 located approximately half way between the top edge 24 of the rear panel 16 and the outer edge 43 of the second closure flap 42 and inserted inside the envelope pocket 17 during the initial mailing of the envelope 10. The side edges of the closure flap 42 taper inwardly toward the edge 43 to facilitate insertion of the second closure flap 42 in the envelope pocket 17. The folded return closure flap 42 is retained in the envelope pocket 17 by the side flaps 38 against the rear panel 16. The second closure flap 42 is larger than the first closure flap 40 and is dimensioned so that when it is withdrawn from the envelope pocket 17 and unfolded, it can be laid over the front panel 14 to substantially cover the lower panel portion 32.

Figure 8:
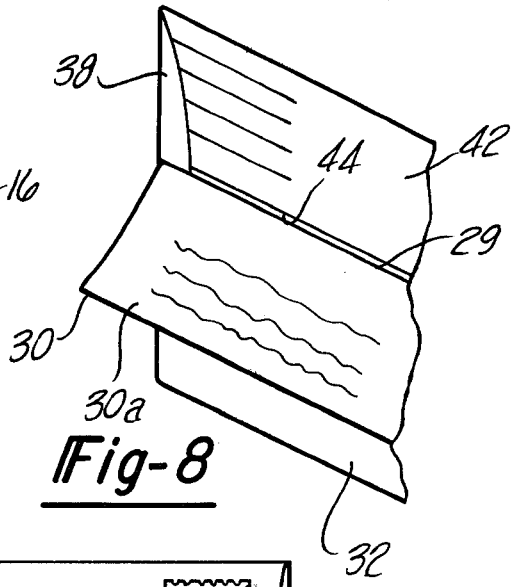
FIG. 8 is a fragmentary perspective view of the remailable envelope of this invention showing an upper panel portion of the front panel folded back with the return or second closure flap folded and positioned within the envelope.

As seen in FIG. 8, the perforated line 29 is positioned intermediate the top edge 18 and the lower edge 20 of the front panel 14 so that when the upper panel portion 30 is folded away from the rear panel 16 or detached from the front panel 14, the edge 44 of the second closure flap 42 will be slightly above and in close proximity to the upper edge (line 29) of lower panel portion 32. Thus, it is easy for the initial addressee to grasp and remove the second closure flap 42 from the envelope body.

In use, the reusable envelope 10 is shown in FIG. 1 prepared for its initial mailing. An addressed billing statement is deposited in the envelope pocket 17 with the address information being displayed through the window 36. The upper panel portion 30 is positioned in a face-to-face relationship with the rear panel 14 and the first closure flap 40 closes the mouth of the envelope and is secured to the exposed surface of the rear panel 16 to seal the envelope. For the initial mailing, as shown in FIG. 8, the second closure flap 42 is folded upon itself at the fold line 44 with the lowermost portion being folded beneath the uppermost portion. The second closure flap 42 is positioned in its folded condition in a face-to-face relationship with the rear panel 16. The side flaps 38 hold the second closure flap 42 against the rear panel 16 so that it remains in an out-of-the-way location.

The addressee who receives the envelope 10 will cut it open along the upper edge 18. The sides of the upper panel portion 30 are not secured to the side flaps 38 and the length of the upper panel portion 30 is less than the length of the rear panel 16 thereby enabling unhindered entry of a letter opener for facilitating the opening of the envelope. After the envelope is opened, the upper panel portion 30 is folded back along the perforated line 29. The upper panel portion 30 can have advertising information imprinted on its inner surface **30*a* (FIG. 8) which would be exposed to the address upon opening the envelope. Similarly, the inside surface of the upper panel portion 30 could have indicia requiring addressee response thereto. For instance, the upper panel portion 30 could take the form of an ordering blank which could be detached and filled out and inserted back into the envelope 10** for remailing to the sender.

Figure 3:
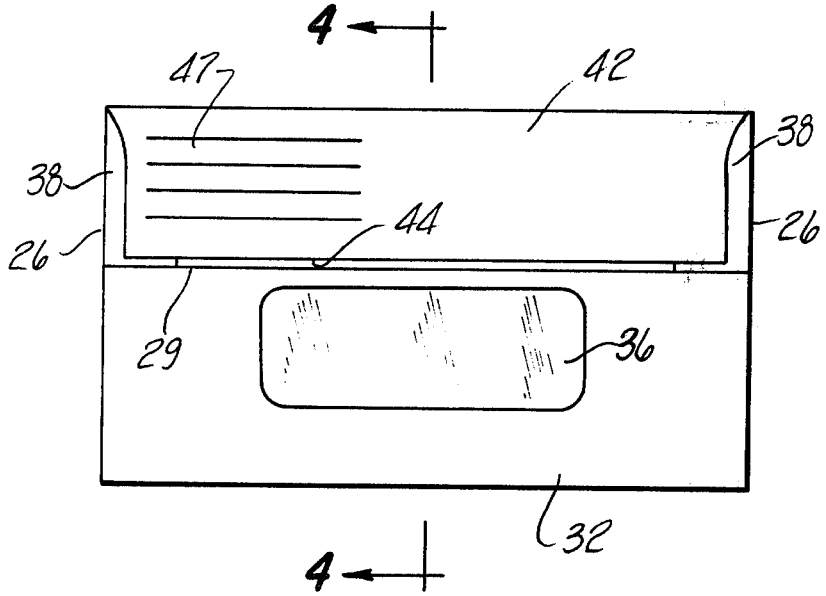
FIG. 3 is a front elevational view of the remailable envelope of this invention showing a return or second closure flap partially removed from the envelope pocket.
Figure 4:
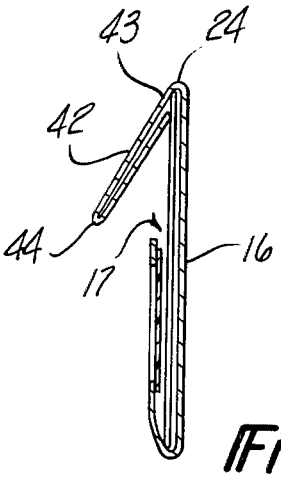
FIG. 4 is a transverse sectional view of the envelope of this invention taken substantially from line 4—4 in FIG. 3.
Figure 5:
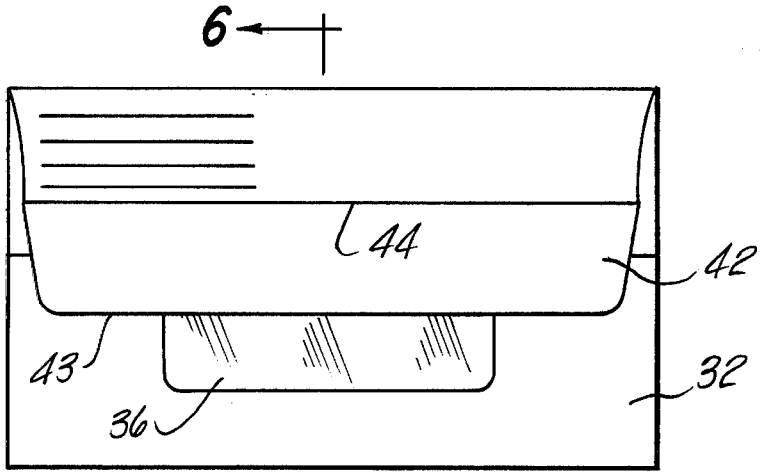
FIGS. 5 and 6 illustrate the return closure flap of the remailable envelope of the present invention in a position partially overlying the front panel of the envelope.
Figure 6:
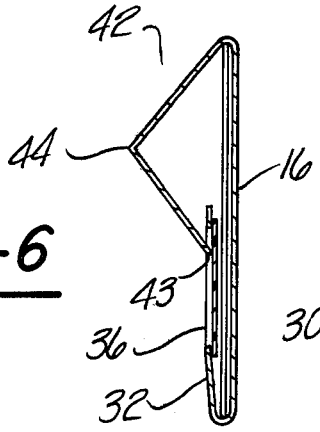
Figure 7:
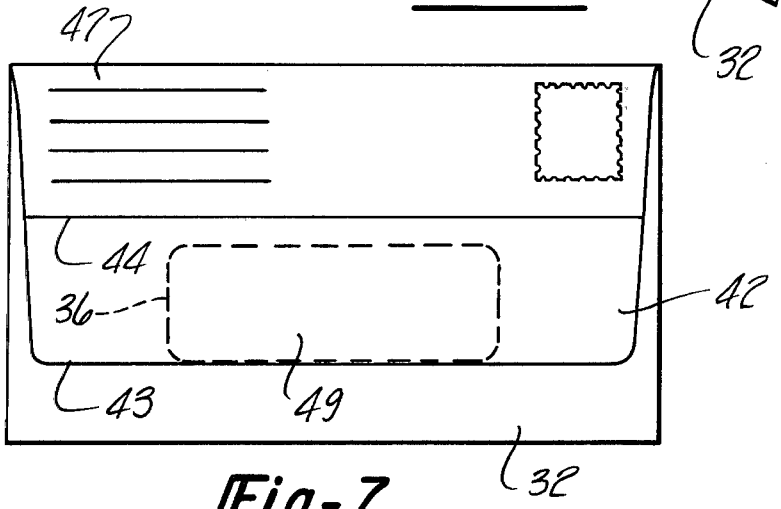
FIG. 7 is an elevational view of the remailable envelope of this invention showing the return closure flap in a sealed position with the envelope ready for remailing.

After the upper panel portion 30 is removed, the second closure flap 42 easily is withdrawn from the envelope pocket 17 because the lowermost edge of the folded flap 42 defined by the fold line 44 is above the juncture between the upper panel portion 30 and the lower panel portion 32 at the perforated line 29 as shown in FIGS. 3 and 4. The closure flap 42 is then unfolded, as shown in FIGS. 5 and 6 and is positioned to overlie the front panel 14. The second closure flap 42 is dimensioned so that it substantially covers the front panel 14. As shown in FIG. 7, when the second closure flap 42 is positioned to lie flat against the front panel 14, it will completely cover the window 36 at the lower panel portion 32. The return address information of the addressee can be imprinted at the upper left-hand corner 47 of the second closure flap 42. The address information of the second addressee can then be imprinted at the usual location 49 on the closure flap 42. If the envelope 10 is to be returned to the original sender, the address information of the sender can be already imprinted upon the second closure flap 42 to expedite the mailing and ensure proper return of the envelope 10 to the original sender.

The remailable envelope 10 can be provided without a window 36 so that the address information of the original addressee will be imprinted direclty on the lower panel portion 32. When the second closure flap 42 is positioned to overlie the front panel 14, it will conceal the address information of the original addressee and exhibit the address information of a subsequent addressee.

From the above description, it can be seen that an improved remailable envelope 10 is provided which facilitates preparation of the envelope for remailing. The second closure flap 42 is greater in size than the first closure flap 40 so that it will conceal the address information of the original addressee. Also, because the upper panel portion 30 can be folded back, the second closure flap is exposed and easily grasped as the juncture between the upper panel portion 30 and the lower panel portion 32 is below the fold 42 of the second closure flap 42, it can be easily grasped and removed from the envelope pocket. The upper panel portion 30 can have advertising information or order blank information imprinted on its surface for insertion into the envelope and remailing to the sender.

It is claimed:

1. A remailable envelope comprising an envelope body having front and rear panels, each of said panels having top, bottom and side edges, means securing said panels together to form an envelope pocket, said front panel comprising upper and lower panel portions and being adapted to exhibit address indicia, said upper panel portion being foldable toward and away from a face-to-face relationship with said rear panel, a first closure flap connected to said upper panel portion at the top edge of said front panel for closing the mouth of said envelope pocket, a second closure flap connected to said rear panel and operable to overlie a substantial portion of said front panel during reuse of said envelope, said second flap being of a size sufficient to cover said front panel to overlie said address indicia and being adapted to exhibit a second address for remailing of the envelope, said second flap being folded upon itself and inserted in said envelope pocket during the first mailing of the envelope, said upper panel portion of said front panel being foldable away from said rear panel to expose said folded second panel for expeditious withdrawal thereof from said envelope pocket.

2. The remailable envelope according to claim 1, wherein said front panel includes a weakened portion extending transversely between said front panel sides intermediate the top and bottom edges thereof to define a juncture between said upper and lower panel portions, whereby the inside surface of said upper panel portion can be provided with information that is visible when said upper panel portion is folded away from said rear panel.

3. The remailable envelope according to claim 2, wherein said weakened portion comprises a perforated line enabling said upper panel portion to be removed from said envelope body.

4. The remailable envelope according to claim 3, wherein said upper panel portion includes indicia enabling addressee response thereon, said upper panel portion thereafter being insertable in said envelope pocket for transmittal during a second mailing of said envelope.

5. The remailable envelope according to claim 1, wherein said front panel has a window therein enabling the address of an addressee to be imprinted on an item inserted in said envelope pocket and displayed through said window.

6. The remailable envelope according to claim 5, wherein said second closure flap is of a size sufficient to cover said window when said second closure flap is withdrawn from said envelope pocket and unfolded to overlie said front panel.

7. The remailable envelope according to claim 1, and further including side flaps on opposite sides of said envelope pocket operable to retain said second closure flap in said pocket during the first mailing of said envelope.

8. The remailable envelope according to claim 2, wherein said weakened portion in said front panel is located in close proximity to the lowermost edge of said folded second closure flap so that when said upper panel portion of said front panel is folded away from said rear panel said lowermost edge of said folded second closure flap can be grasped for withdrawing said second closure flap from said envelope pocket.

9. The remailable envelope according to claim 8, wherein said front panel weakened portion is positioned below said lowermost edge of said folded second closure flap.

* * * * *